US005636801A

United States Patent [19]

Kroger

[11] Patent Number: 5,636,801

[45] Date of Patent: Jun. 10, 1997

[54] ONE PIECE MOLDED STRIPPER FOR SHREDDERS

[75] Inventor: Bruce R. Kroger, West Chicago, Ill.

[73] Assignee: Fellowes Mfg. Co., Itasca, Ill.

[21] Appl. No.: 510,386

[22] Filed: Aug. 2, 1995

[51] Int. Cl.[6] ..... B02C 18/16

[52] U.S. Cl. ..... 241/167; 241/236; 241/295

[58] Field of Search ..... 241/166, 167, 241/236, 295, 294

[56] References Cited

U.S. PATENT DOCUMENTS

| | | |
|---|---|---|
| 1,019,828 | 3/1912 | O'Bryan . |
| 1,090,914 | 3/1914 | Guettler . |
| 1,178,386 | 4/1916 | Edwards . |
| 1,673,336 | 6/1928 | Lehmicke . |
| 1,699,157 | 1/1929 | Pendleton . |
| 1,731,967 | 10/1929 | Antonsen . |
| 2,182,219 | 12/1939 | Ashley . |
| 2,202,843 | 6/1940 | Edwards . |
| 2,216,612 | 10/1940 | Dimm et al. . |
| 2,224,948 | 12/1940 | Bloomquist . |
| 2,236,969 | 4/1941 | Flateboe . |
| 2,259,015 | 10/1941 | Anderson et al. . |
| 2,381,775 | 8/1945 | Roddy . |
| 2,554,114 | 5/1951 | Menkin et al. . |
| 2,657,720 | 11/1953 | Wolfe . |
| 2,770,302 | 11/1956 | Lee . |
| 2,873,923 | 2/1959 | Bergman . |
| 2,894,697 | 7/1959 | Panning et al. . |
| 3,033,064 | 5/1962 | Lee . |
| 3,126,931 | 3/1964 | Blanshine et al. . |
| 3,286,574 | 11/1966 | Durand . |
| 3,369,763 | 2/1968 | Perry . |
| 3,396,914 | 8/1968 | Liebman . |
| 3,510,077 | 5/1970 | Priscu . |
| 3,524,597 | 8/1970 | Burden, Jr. et al. . |
| 3,529,782 | 9/1970 | Liebman . |
| 3,620,461 | 11/1971 | Pelleschi et al. . |
| 3,620,462 | 11/1971 | Dooley, Jr. . |
| 3,630,460 | 12/1971 | Goldhammer . |
| 3,664,592 | 5/1972 | Schweigert et al. . |
| 3,682,402 | 8/1972 | Goldhammer . |
| 3,711,034 | 1/1973 | Ehinger . |
| 3,724,766 | 4/1973 | Bosland . |
| 3,790,093 | 2/1974 | McIntyre . |
| 3,797,765 | 3/1974 | Samuels . |
| 3,860,180 | 1/1975 | Goldhammer . |
| 3,880,361 | 4/1975 | Schwarz . |
| 3,894,697 | 7/1975 | Lawson et al. . |
| 3,921,920 | 11/1975 | Brocard . |
| 3,931,935 | 1/1976 | Holman . |
| 3,960,334 | 6/1976 | Wudyka . |
| 4,009,838 | 3/1977 | Tashman . |
| 4,018,392 | 4/1977 | Wagner . |
| 4,034,918 | 7/1977 | Culbertson et al. . |
| 4,068,805 | 1/1978 | Oswald . |
| 4,106,708 | 8/1978 | Kropa . |
| 4,157,671 | 6/1979 | Goldhammer . |
| 4,172,400 | 10/1979 | Brierley . |
| 4,194,698 | 3/1980 | Kosmowski . |
| 4,200,239 | 4/1980 | Simone et al. . |
| 4,226,372 | 10/1980 | Wigand . |

(List continued on next page.)

FOREIGN PATENT DOCUMENTS

| | | |
|---|---|---|
| 10681 | 10/1979 | European Pat. Off. . |
| 0069721 | 6/1982 | European Pat. Off. . |
| 3001507 | 7/1981 | Germany . |
| 3312173A1 | 10/1984 | Germany . |
| 705066 | 3/1954 | United Kingdom . |
| 1468662 | 3/1977 | United Kingdom . |
| 1502076 | 2/1978 | United Kingdom . |
| 1569375 | 6/1980 | United Kingdom . |
| 2059804 | 4/1981 | United Kingdom . |
| 2097717 | 11/1982 | United Kingdom . |

*Primary Examiner*—Mark Rosenbaum
*Attorney, Agent, or Firm*—Mary V. Rogers; Brinks Hofer Gilson & Lione

[57] ABSTRACT

A stripper for use on a cutting cylinder having a shaft. The stripper comprising a unitary, resilient body and an arcuate recess in the mid-portion of the body adapted to surround at least about 180 degrees of the circumference of the shaft of the cylinder.

15 Claims, 3 Drawing Sheets

U.S. PATENT DOCUMENTS 4,257,565 3/1981 Hatanaka .
4,260,115 4/1981 Hatanaka .
4,330,092 5/1982 Roman .
4,334,650 6/1982 Hardwick et al. .
4,346,851 8/1982 Bernardi et al. .
4,349,159 9/1982 Hardwick et al. .
4,351,485 9/1982 Hardwick et al. .
4,355,766 10/1982 Wigand .
4,363,453 12/1982 Hill et al. .
4,385,732 5/1983 Williams .
4,394,983 7/1983 Ulsky .
4,399,946 8/1983 Stevenson .
4,411,391 10/1983 Crane .
4,426,044 1/1984 Butler .
4,489,897 12/1984 Turner et al. .
4,522,096 6/1985 Niven, Jr. .
4,545,537 10/1985 Kimura et al. .
4,557,421 12/1985 Probst et al. .
4,558,827 12/1985 Berger .
4,562,971 1/1986 Schwelling .
4,564,146 1/1986 Bleasdale .
4,565,330 1/1986 Katoh .
4,615,490 10/1986 Goldhammer .
4,619,407 10/1986 Goldhammer .
4,625,925 12/1986 Goldhammer .
4,627,581 12/1986 Holiman et al. .
4,627,582 12/1986 Goldhammer .
4,637,560 1/1987 Goldhammer .
4,650,128 3/1987 Goldhammer .
4,651,610 3/1987 Schwelling .
4,657,192 4/1987 Browning .
4,688,730 8/1987 Dahle .
4,690,340 9/1987 Hatanaka .
4,691,871 9/1987 Mochizuki .
4,693,428 9/1987 Raterman et al. .
4,709,197 11/1987 Goldhammer et al. .
4,717,085 1/1988 Crane .
4,773,603 9/1988 Schwelling .
4,809,916 3/1989 Schwelling .
4,830,295 5/1989 Schwelling .
4,860,963 8/1989 Goldhammer et al. .
4,881,692 11/1989 Goldhammer et al. .
4,889,291 12/1989 Goldhammer et al. .
4,919,345 4/1990 Burlington et al. .
4,936,517 6/1990 Kammerer et al. .
4,997,134 3/1991 MacGregor .
5,044,270 9/1991 Schwelling .
5,071,080 12/1991 Herbst et al. .
5,141,168 8/1992 Pepper .
5,170,702 12/1992 Schwelling .
5,230,477 7/1993 Strohmeyer .
5,261,614 11/1993 Schwelling .
5,295,633 3/1994 Kimbro et al. .
5,409,171 4/1995 Stangenberg et al. .

ONE PIECE MOLDED STRIPPER FOR SHREDDERS

BACKGROUND OF THE INVENTION

This invention pertains to the field of shredders. More specifically, this invention pertains to paper shredders.

Paper shredders comprise at least one cutting cylinder and, typically, a pair of opposed cutting cylinders. Most cutting cylinders consist of a shaft and a plurality of spaced apart cutting disks. Strippers are commonly used in paper shredders to keep particles of paper away from the circumference of the shaft and thus avoid build up, jamming and diminished speed of the cylinders.

The prior art contains many examples of strippers. In order to obtain the ideal amount of coverage, many shredders currently include two piece strippers. Although two piece strippers are capable of producing the requisite coverage, they are problematic because they make assembly of the cutting cylinders difficult.

A one piece stripper that would effectively keep cut particles in the proper paper path and strip particles away from the circumference of the spacers between the cutting disks would be a welcome improvement in the art.

SUMMARY

The present invention includes a stripper for use on a cutting cylinder having a shaft, the stripper comprising a unitary, resilient body and an arcuate recess in the mid-portion of the body adapted to surround at least about 180 degrees of the circumference of the shaft of the cylinder. The invention also includes a paper shredder comprising at least one cutting cylinder which incorporates the novel stripper.

One of the advantages of the stripper of the present invention is that it makes assembly of the cutting cylinder very easy. In addition, the new stripper is inexpensive.

DETAILED DESCRIPTION OF THE DRAWINGS AND PREFERRED EMBODIMENTS OF THE INVENTION

Figure 4:
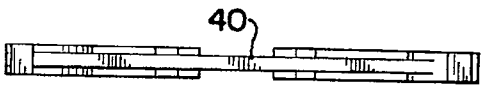
FIG. 4 is a rear view of the stripper of FIG. 3
Figure 1:
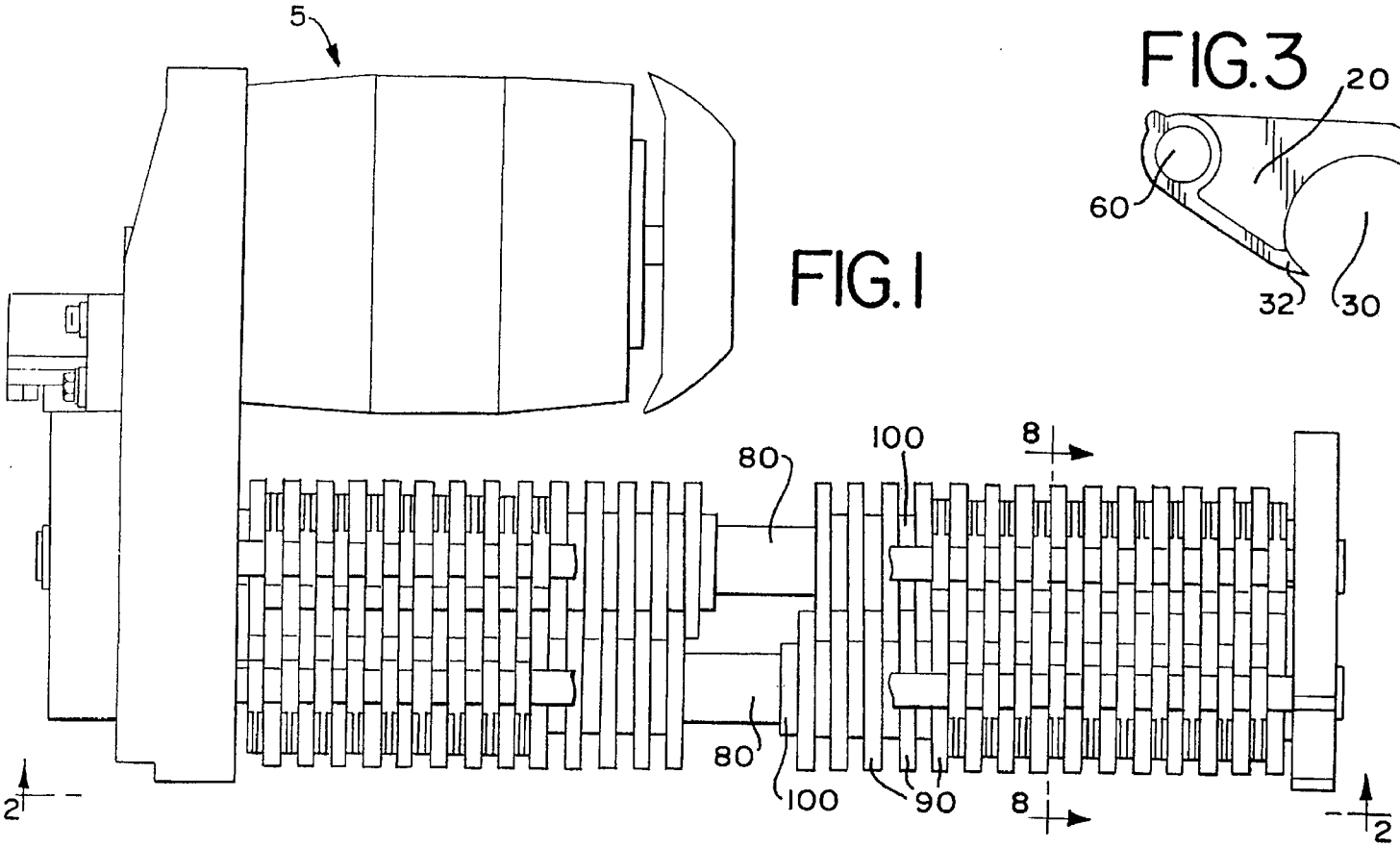
FIG. 1 is a top view of a shredding machine which includes the stripper of the present invention.

FIG. 1 depicts a shredding machine 5 which includes the stripper 10 of the present invention. A first embodiment of the stripper 10 of the present invention is most clearly illustrated in FIGS. 3–5. The stripper 10 includes a unitary body 20 manufactured from a resilient material. The body 20 has an arcuate recess 30 located in its mid-portion. The stripper 10 may also include means for maintaining the stripper 10 in the proper orientation with respect to the shaft 80. In the preferred embodiment, the body 20 includes two apertures 50, 60 which accomplish this function in a manner which will be described below.

Figure 2:
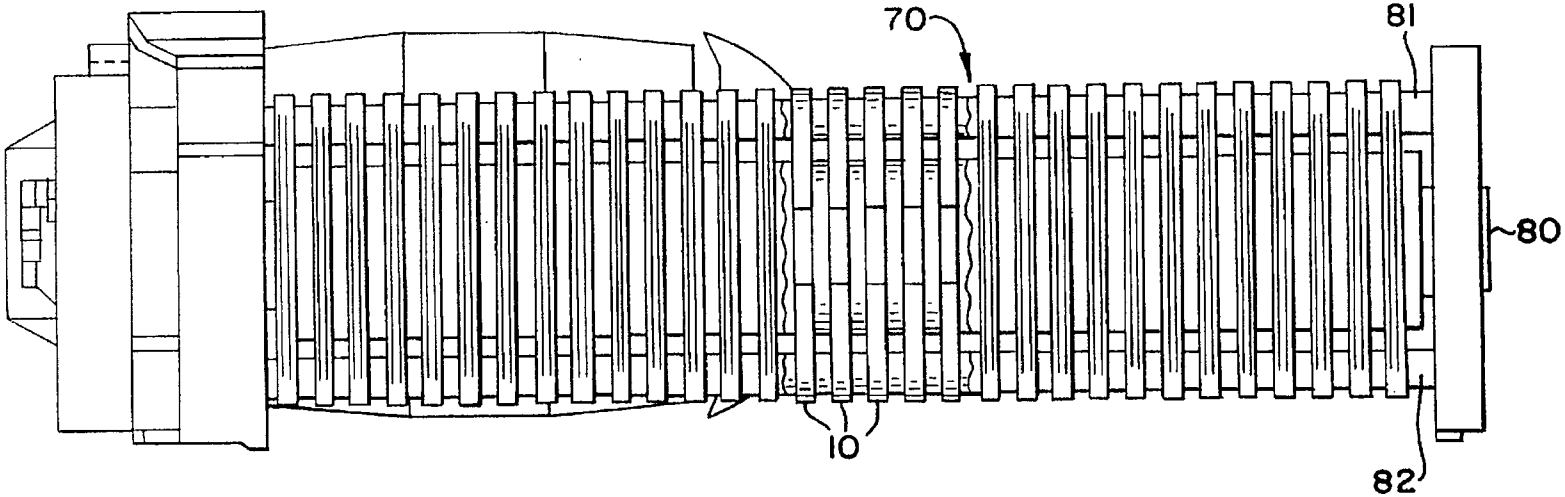
FIG. 2 is an elevational view of the front of the shredder of FIG. 1 taken along the line 2—2 with a section cut away from the mid-portion of the cutting cylinder.
Figure 8:
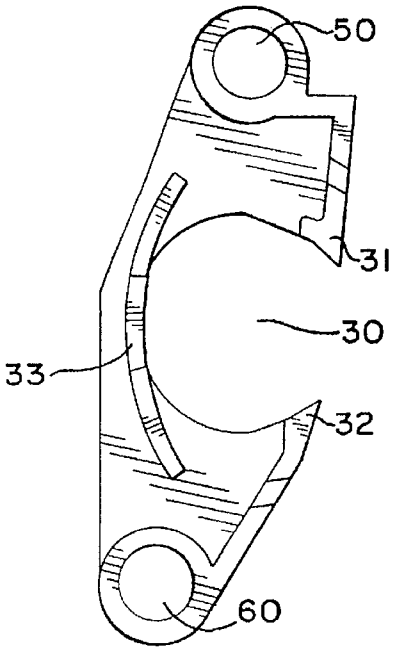
FIG. 8 is a side view of a third embodiment of the stripper of the present invention.
Figure 9:
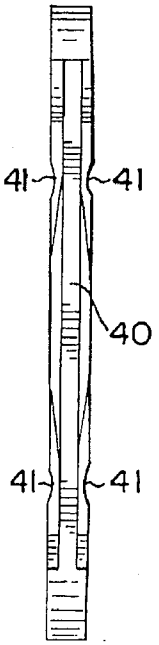
FIG. 9 is a rear view of the stripper of FIG. 9.

The relationship of the stripper 10 to a cutting cylinder 70 is clearly illustrated in FIGS. 2 and 8. In the preferred embodiment, the cutting cylinder 70 includes a shaft 80 with a plurality of spaced apart cutting disks 90 arranged on the shaft 80. Also in the preferred embodiment, the cutting cylinder 70 includes a plurality of spacers 100 arranged on the shaft 80 in between the cutting disks 90. Preferably, the cutting disks 90 and the spacers 100 are either integral with each other or combined to form a single component. The resilient body 20 of the stripper 10 enables the stripper 10 to be snapped into position around the shaft 80 of an assembled cutting cylinder 70. This facilitates manual assembly of the cutting cylinder 70. In the preferred embodiment, the strippers 10 are positioned along the cutting cylinder 70 so that the recess 30 in the stripper 10 surrounds at least about 180 degrees of the circumference of the shaft 80. Preferably, the recess 30 surrounds between about 245 to about 315 degrees of the shaft 80, more preferably about 270 degrees. In the most preferred embodiment, every spacer 100 on the cutting cylinder 70 is associated with a stripper 10 such that the recess 30 in the stripper 10 surrounds at least about 180 degrees of the circumference of the spacer 100, more preferably, about 245–315 degrees, and most preferably about 270 degrees. As illustrated in FIG. 9, it is preferable to place notches 41 along the backbone 40 of the stripper 10. The notches 41 ensure that the wide edges of the stripper 10 will not be snagged by the adjacent cutting disks 90 as the cutting disks rotate around the shaft 80.

Figure 3:
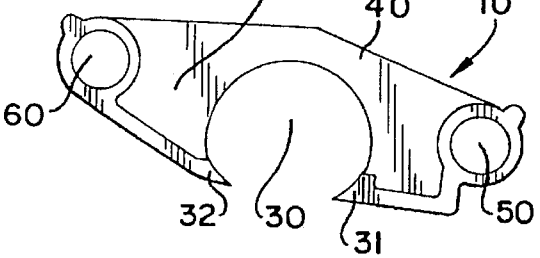
FIG. 3 is a side view of a first embodiment of the stripper of the present invention.
Figure 5:
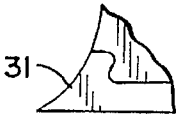
FIG. 5 is an exploded view of the beginning of the recess in the stripper of FIG. 3.
Figure 6:
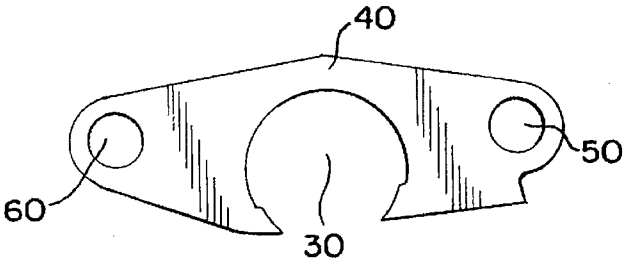
FIG. 6 is a side view of a second embodiment of the stripper of the present invention.

Although it is imperative that the circumference of the shaft 80 or spacer 100 is substantially surrounded, it is also desirable to keep the area of the recess 30 that actually touches the shaft 80 or spacer 100 to a minimum so that friction and heat loss are minimized. To address this problem, the stripper may include a plurality of pads or raised portions. In one embodiment, depicted in FIGS. 3 and 4, the stripper has two pads, or raised portions 31, 32 at the beginning and the end of the recess 30. Raised portion 31 is positioned at the beginning of the recess 30. Raised portion 32 is positioned at the end of the recess 30. The raised portions 31, 32 of the recess 30, touch the shaft 80 or the spacer 100. Although the raised portions 31, 32 may have square comers as shown in FIG. 6, it is preferable to have the pad 31, 32 slope backward to meet the recess as depicted in FIG. 3 and 5. Sloping the pad to meet the recess decreases the space between the shaft 80 or the spacer 100 and the stripper 10. Consequently, the possibility that paper might gather in that space is decreased.

Figure 7:
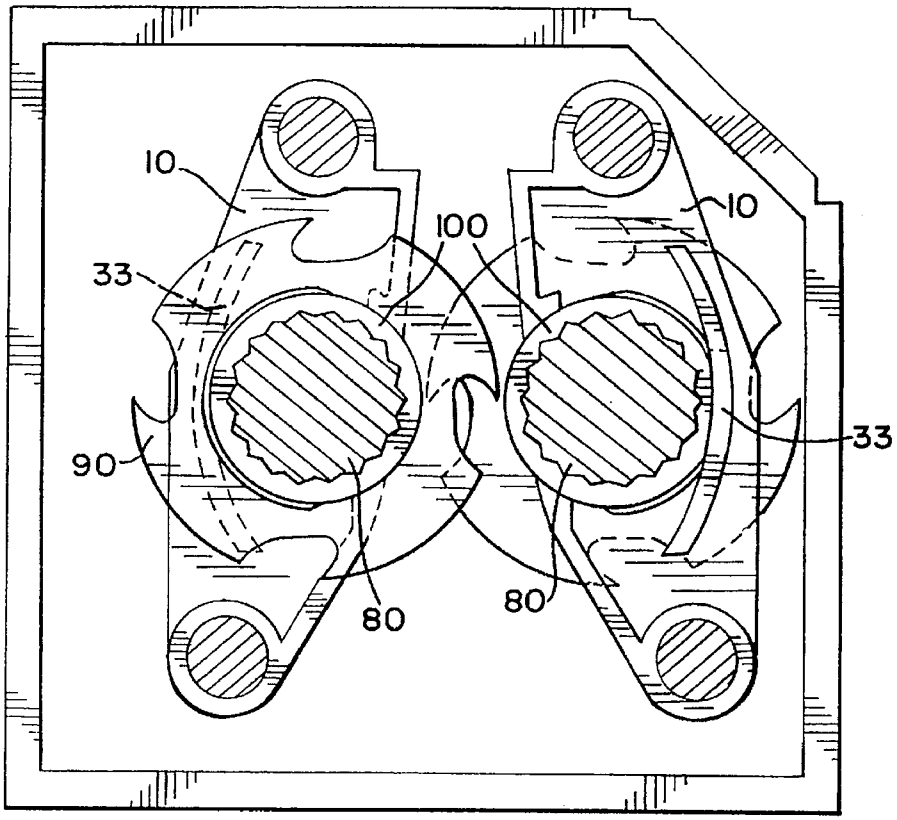
FIG. 7 is a cross sectional view of the shredder of FIG. 1 taken along the line 8—8.

In the most preferred embodiment, illustrated in FIGS. 7–9, the stripper 10 has three pads or raised portions: raised portion 31, at the beginning of recess 30, raised portion 32 at the end of recess 30 and raised portion 33 positioned along the middle of recess 30. Oftentimes, the shafts 80 of the 'cutting' cylinders 70 flex during use when they experience an increased load. As clearly shown in FIG. 7, the third pad 33 holds the stripper 10 in contact with the shaft 80 or spacer 100 when the shaft 80 flexes and thus ensures that the shredder 5 continues to function properly.

The shredder 5 may also include some means of maintaining the orientation of the strippers 10 with respect to the shaft 80 of the cutting cylinder 70. In the preferred embodiment, depicted in FIG. 2, the proper orientation of the stripper 10 to the shaft 80 is maintained by inserting distance shafts 81, 82 into apertures 50, 60. Then, the entire cutting cylinder 70 is inserted into the frame of the shredder 5 and beating plates are attached.

The stripper 10 is preferably made of plastic, more preferably self-lubricating plastic such as nylon or delrin. The stripper 10 may be formed in any feasible manner. The preferred stripper 10 is injection molded.

There are numerous advantages to the stripper 10 of the present invention. First, the resilient body creates a hinged backbone 40 which enables the stripper 10 to surround a larger area than the one piece strippers currently available in the art. In addition, the use of the stripper 10 results in greater ease and significant cost savings in the assembly process.

Another advantage is that the stripper 10 is designed to be used efficiently in a shredder 5 capable of operating in a forward and reverse direction. The top portion of the stripper 10 forms the paper guide for the uncut paper when the shredder 5 is operated in the forward direction. This allows the stripper 10 to be more effective in keeping cut particles in the desired paper path. When the shredder 5 is operated in the reverse direction, the top portion performs the stripping function and thus strips particles away from the circumference of the spacers between the cutting blades.

Furthermore, the self-lubricating properties of the plastic reduce both the overall noise of the operating shredder and premature wear of the stripper itself. It is believed that the self-lubricating plastic may alleviate the periodic need to oil the shredder.

It should be appreciated that the stripper of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed:

1. A stripper for use with a cutting cylinder having a shaft, the stripper comprising:

a) a unitary, resilient body having a centrally located hinged backbone;

b) an arcuate recess in the mid-portion of the body adapted to surround only from 220 to 315 degrees of the circumference of the shaft of the cutting cylinder; and c) a plurality of pads, the pads positioned along the arcuate recess at those points where the recess is adapted to contact the shaft.

2. The stripper recited in claim 1 further comprising at least one aperture located in the body of the stripper for maintaining the orientation of the stripper with respect to the cutting cylinder.

3. The stripper recited in claim 2 wherein there are two apertures, one at the top of the body and the other at the bottom of the body.

4. The stripper recited in claim 1 made of self-lubricating plastic.

5. A stripper for use on a cutting cylinder having a shaft comprising:

a) a unitary, resilient body having a centrally located hinged backbone;

b) two apertures, one aperture located at the top of the body and the other aperture located at the bottom of the body;

c) an arcuate recess positioned between the apertures, the recess surrounding only from 220 to 315 degrees of the circumference of the shaft of the cutting cylinder; and d) a plurality of pads, the pads positioned along the arcuate recess at those points where the recess is adapted to contact the shaft.

6. A cutting cylinder for use in a shredder comprising:

a) a shaft;

b) a plurality of spaced apart cutting disks arranged on the shaft; and c) a plurality of strippers arranged between at least some of the cutting disks, each stripper comprising:

i) a resilient, unitary body having a centrally located hinged backbone;

ii) an arcuate recess located in the mid-portion of the body, the recess configured so that it surrounds only from 220 to 315 degrees of the circumference of the shaft; and iii) a plurality of pads, the pads positioned along the arcuate recess at those points where the recess contacts the shaft.

7. The cutting cylinder of claim 6 wherein the stripper further comprises a plurality of notches positioned along the backbone of the stripper.

8. The cutting cylinder of claim 6 further comprising a plurality of spacers arranged between the cutting disks on the shaft.

9. The cutting cylinder of claim 8 wherein the arcuate recess in the body of the stripper surrounds only from 220 to 315 degrees of the circumference of the spacer.

10. The cutting cylinder recited in claim 9 wherein there are two apertures, one at the top of the body and the other at the bottom of the body.

11. The cutting cylinder of claim 6 wherein the cutting disks and the spacers comprise a single component.

12. The cutting cylinder recited in claim 6 further comprising at least one aperture located in the body of the stripper for maintaining the orientation of the stripper with respect to the cutting cylinder.

13. The cutting cylinder recited in claim 6 wherein the stripper is made of self-lubricating plastic.

14. A shredding machine having a pair of opposed cutting cylinders, each cutting cylinder having a shaft, a plurality of spaced apart cutting disks arranged on the shaft, and a plurality of strippers arranged between at least some of the cutting disks, each stripper comprising:

a) a unitary, resilient body having a centrally located hinged backbone;

b) an arcuate recess located in the mid-portion of the body, the recess configured so that it surrounds only from 220 to 315 degrees of the circumference of the shaft; and c) a plurality of pads, the pads positioned along the arcuate recess at those points where the recess contacts the shaft.

15. A cutting cylinder for use in a shredder comprising:

a) a shaft;

b) a plurality of spaced apart cutting disks arranged on the shaft; and c) a plurality of strippers arranged between at least some of the cutting disks, each stripper comprising:

i) a resilient, unitary body having a centrally located hinged backbone;

ii) an arcuate recess located in the mid-portion of the body, the recess configured so that it surrounds only from 220 to 315 degrees of the circumference of the shaft; and iii) a plurality of notches positioned along the backbone of the stripper.

* * * * *